US007535801B1

(12) United States Patent
Porzio

(10) Patent No.: US 7,535,801 B1
(45) Date of Patent: May 19, 2009

(54) MULTIPLE FREQUENCY SONAR TRANSDUCER

(75) Inventor: Raymond Porzio, LaFayette, NY (US)

(73) Assignee: Lockheed Martin Corporation, Bethesda, MD (US)

( * ) Notice: Subject to any disclaimer, the term of this patent is extended or adjusted under 35 U.S.C. 154(b) by 176 days.

(21) Appl. No.: 11/414,518

(22) Filed: Apr. 28, 2006

Related U.S. Application Data

(60) Provisional application No. 60/676,150, filed on Apr. 29, 2005.

(51) Int. Cl.
*H04R 17/00* (2006.01)

(52) U.S. Cl. ..... 367/158; 367/163; 367/174

(58) Field of Classification Search ..... 367/158, 367/163, 174; 310/337
See application file for complete search history.

(56) References Cited

U.S. PATENT DOCUMENTS 3,258,738 A 6/1966 Merchant
3,769,532 A * 10/1973 Tocquet et al. ..... 310/337
3,860,901 A * 1/1975 Ehrlich et al. ..... 310/337
3,952,216 A * 4/1976 Madison et al. ..... 310/337
4,031,418 A * 6/1977 Cluzel et al. ..... 367/158
4,752,918 A * 6/1988 Boucher et al. ..... 367/158
6,298,012 B1 * 10/2001 Benjamin ..... 367/174
6,643,222 B2 * 11/2003 Osborn et al. ..... 367/174

FOREIGN PATENT DOCUMENTS

GB 2163925 A * 3/1986

* cited by examiner

*Primary Examiner*—Ian J Lobo
(74) *Attorney, Agent, or Firm*—Howard IP Law Group, PC

(57) ABSTRACT

A sonar transducer has a head mass at a distal end thereof, a tail mass at a proximal end thereof, a driver in physical contact with the head mass and the tail mass, and a flextensional body incorporating and extending proximally from the head mass. The flextensional body has relatively thin walls or diaphragms with concave surfaces. The sonar transducer may have a fundamental mode having a relatively low resonant frequency, involving substantially only a bending motion of the diaphragms. A second resonant mode, at a frequency higher than the frequency associated with the fundamental mode, involves both a bending motion of the diaphragms and a membrane or breathing motion of the flextensional body, including the head mass. A third, relatively high frequency resonant mode, involves exclusively or substantially exclusively longitudinal motion of the head mass.

20 Claims, 7 Drawing Sheets

MULTIPLE FREQUENCY SONAR TRANSDUCER

CROSS-REFERENCE TO RELATED APPLICATIONS

This application claims the benefit under 35 U.S.C. 119 (e) of U.S. Provisional Application Ser. No. 60/676,150 filed Apr. 29, 2005.

FIELD OF INVENTION

The present invention relates to sonar transducers, and more particularly to sonar transducers having multiple operating frequencies.

BACKGROUND

Sonar transducers are employed to provide and detect acoustic signals, usually in a fluid such as water. While a variety of configurations of sonar transducers have been used, one existing design is referred to as the tonpilz configuration. In this configuration, the transducer has a tail mass at a proximal end having connections for signals and a source of electrical power, a head mass at a distal end and a stack of ring shaped drivers, such as piezoelectric ceramic elements, electrically connected in parallel, extending longitudinally between and in physical contact with the head mass and the tail mass. A tie rod maintains the stack of drivers under compressive stress. Excitation of the drivers at a frequency of resonance causes the head and tail masses to oscillate longitudinally at a longitudinal frequency of resonance to provide a sonar signal.

Transducers in the longitudinal or tonpilz configuration described above typically have a resonant frequency above about two kilohertz. In these frequency ranges, signals become severely attenuated at long ranges. As attenuation is approximately proportional to the square of the frequency, for a given power level, longer-range communications can be obtained only by providing lower-frequency signals. Lower-resonance frequencies can be obtained by increasing the mass of the head mass and tail mass. However, the useful bandwidth of the signal is roughly inversely dependent on the equivalent mass of the combined head and tail mass. Thus, obtaining a lower frequency by increasing the mass of the head mass and tail mass results in a decreased bandwidth. The bandwidth at low frequencies is roughly proportional to the amount of radiation resistance, which in turn is proportional to the square of the radiating area for low frequency transducers. Thus, at low frequencies, transducers having an increased area at the face of the head mass provide a greater useful bandwidth. However, increasing the area at the face sufficiently to compensate for decreased bandwidth at low frequencies may result in undesirably large transducers with poor beam characteristics, such as excessively narrow beamwidth and deleterious grating lobes.

SUMMARY

In one embodiment of the invention, a sonar transducer has a head mass at a distal end thereof, a tail mass at a proximal end thereof, a driver in physical contact with the head mass and the tail mass, and an inverse flextensional body incorporating and extending proximally from the head mass. An inverse flextensional body has generally vertical, parallel end walls joined by a pair of concave upper and lower walls or diaphragms. The inverse flextensional body in an embodiment of the invention has one end wall defined by the head mass, a second end wall defined by a relatively thick walled end region, and two diaphragms or relatively thin walls on opposite sides having a concave shape and joining the head mass and the second end wall. The sonar transducer may have a fundamental bending mode having a relatively low resonance frequency, involving substantially only a bending motion of the diaphragms. A second resonant mode, at a frequency higher than the frequency associated with the fundamental mode, involves a bending mode of the diaphragms and a radial breathing or membrane mode of the flextensional body. A third, relatively high frequency resonant mode, involves exclusively or substantially exclusively longitudinal motion of the head mass, tail mass and driver.

DETAILED DESCRIPTION OF PREFERRED EMBODIMENTS

Figure 1A:
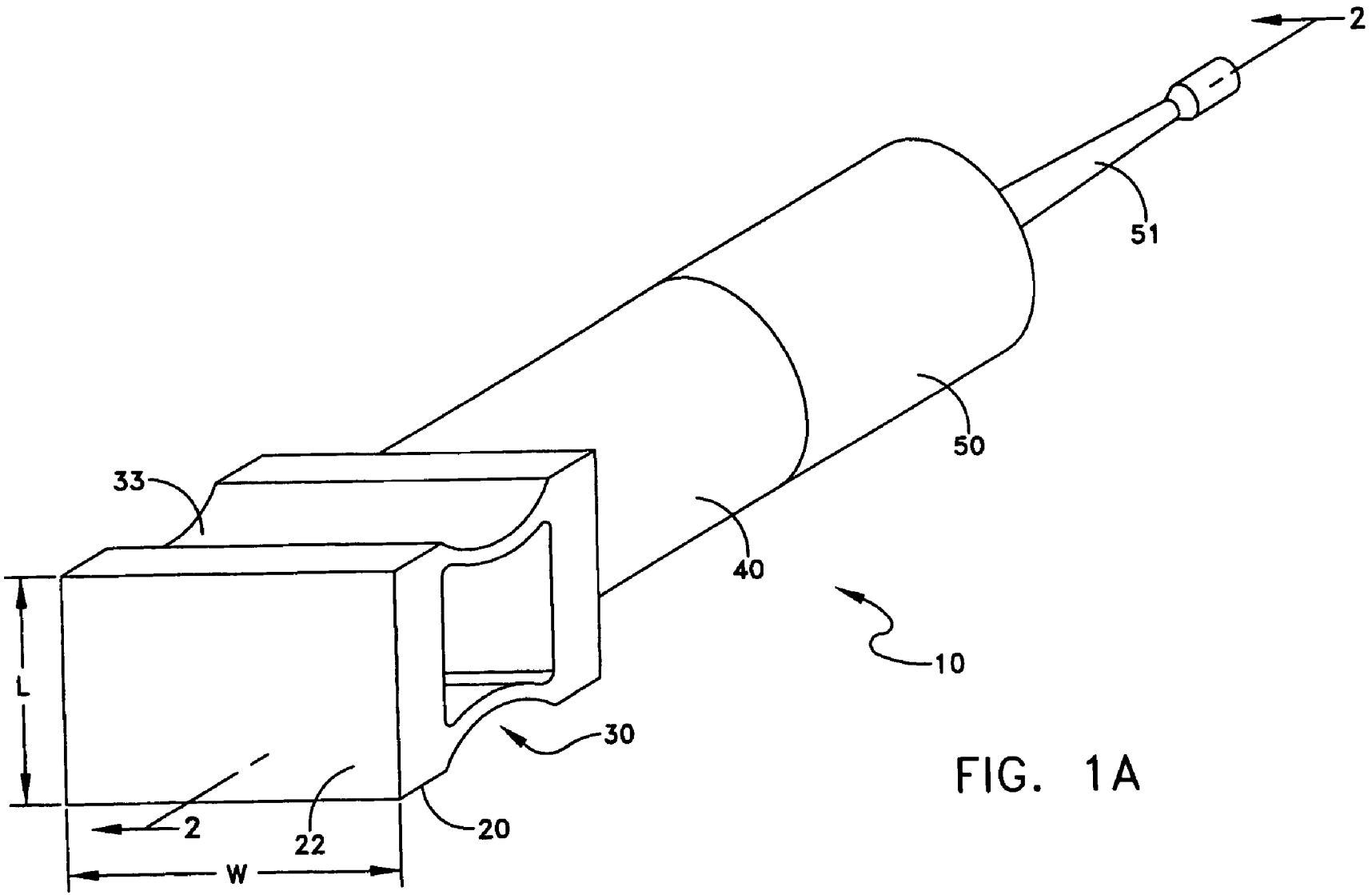
FIG. 1A is an isometric view showing a transducer according to an embodiment of the present invention, without side plates.
Figure 1B:
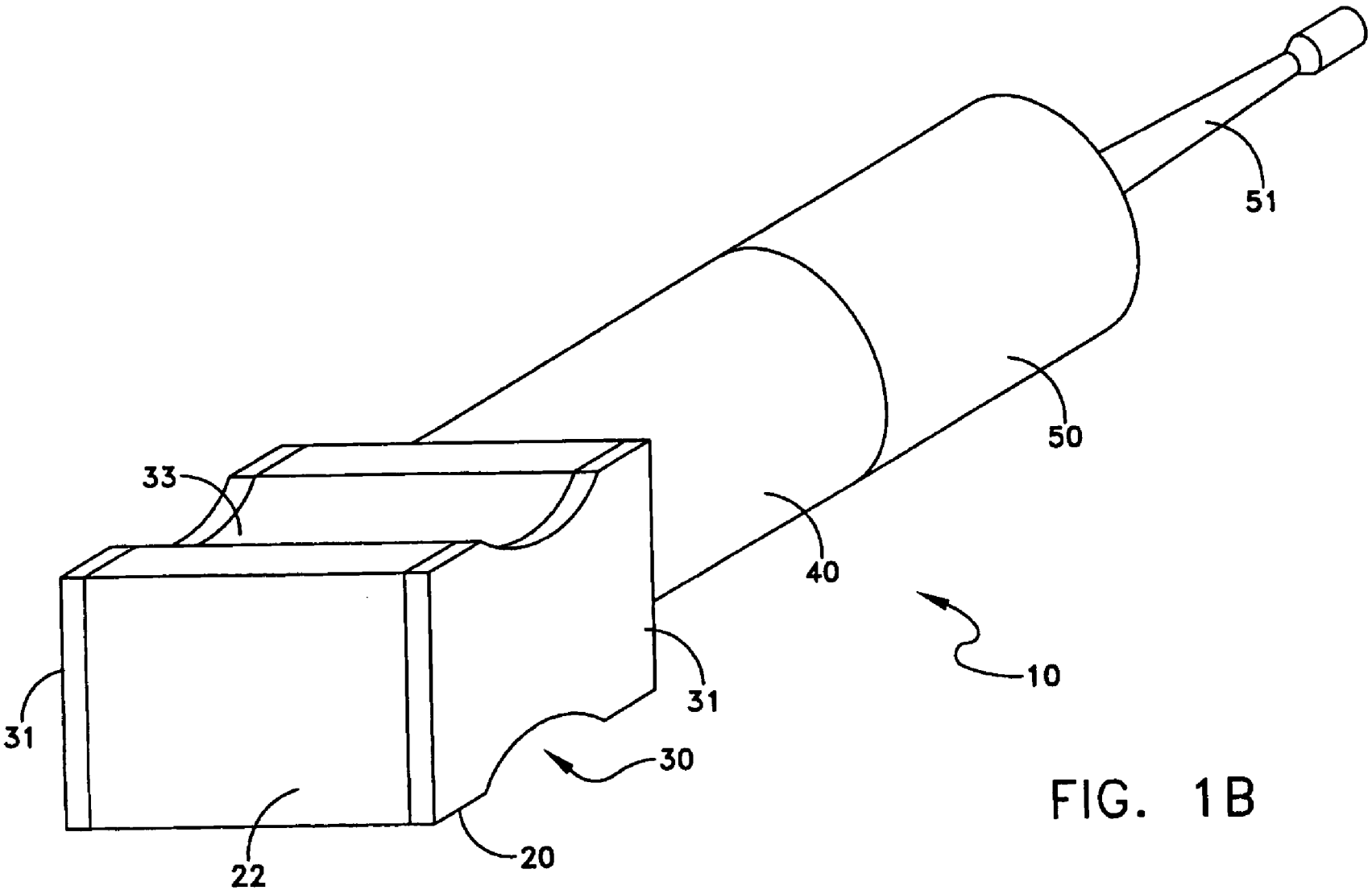
FIG. 1B is an isometric view of a transducer according to an embodiment of the present invention, similar to FIG. 1A, but showing side plates.

Referring to FIGS. 1A and 1B, a transducer 10 according to an embodiment of the invention will now be described. Transducer 10 has a head mass 20 at a distal end of its longitudinal axis, flextensional body 30 including head mass 20 and extending proximally of the head mass 20, an aft section 40 at the proximal end of the longitudinal axis of the transducer, and a rear housing 50. Connector 51 is connected to rear housing 50. Head mass 20 has planar end surface 22. Planar surface 22 is rectangular in the illustrated embodiment, although planar surface 22 may take other forms. Flextensional body 30 has on opposing sides diaphragms 33 having a generally concave cross-sectional shape extending in a direction orthogonal to the long axis of the transducer structure. Side plates 31, shown in FIG. 1B but not FIG. 1A, serve to seal the interior open sides of the flextensional body 30. Side plates 31 are mounted so as not to vibrate with transducer 10. In the illustrated embodiment, side plates 31 may be mounted on tie rods (not shown) extending through flextensional body 30. The tie rods are sufficiently long that the distance separating side plates 31 is slightly greater than the distance separating the sides of flextensional body 30. A suitable material, such as an elastomeric booting material such as neoprene (not shown), is applied to provide a watertight seal, maintain side plates 31 in position, and maintain substantial isolation of side plates 31 from vibrations of flextensional body 30. Aft section 40 and rear housing 50 define a cylindrical body having a diameter smaller than the dimensions (length L, width W) of planar surface 22.

Figure 2:
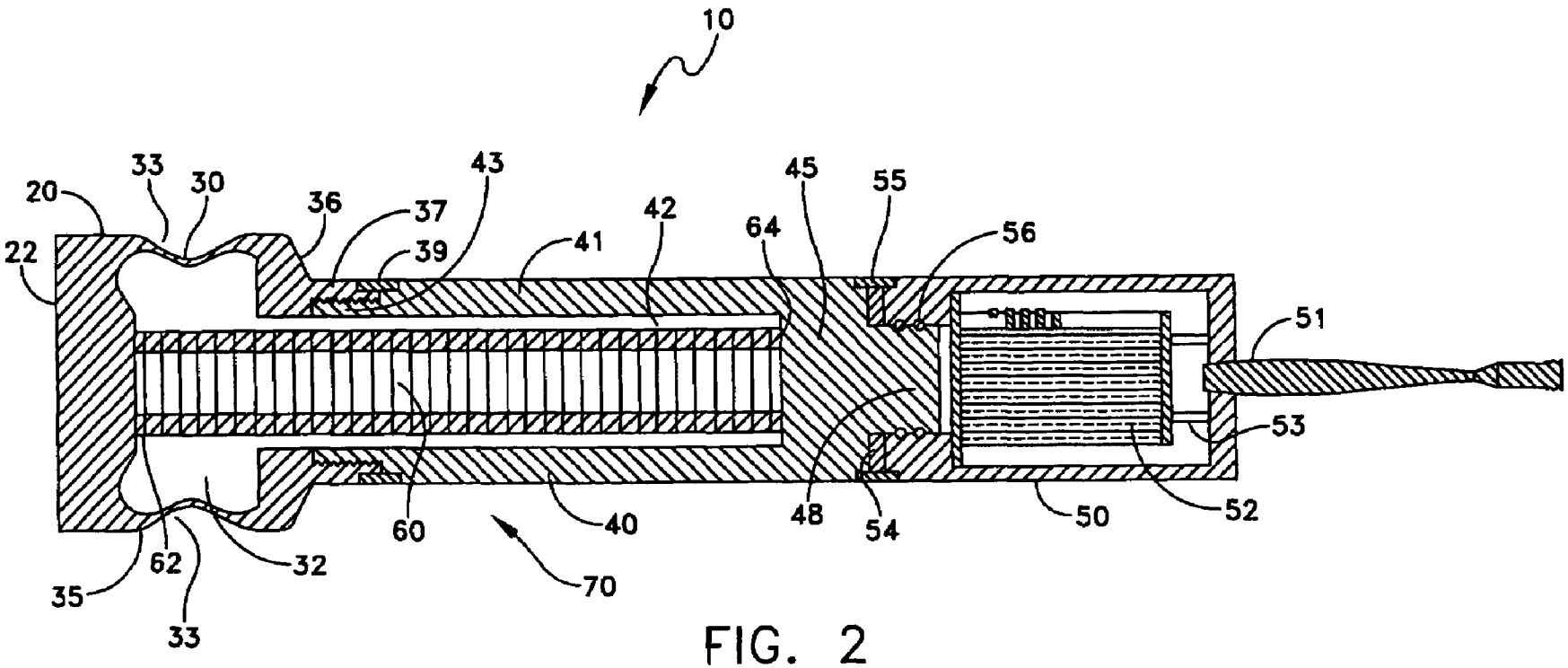
FIG. 2 is a longitudinal sectional view, taken along line 2-2 of FIG. 1A, of the transducer of FIG. 1A.

FIG. 2 shows a longitudinal section of transducer 10 taken along line 2-2 of FIG. 1A. Head mass 20 is solid. Flextensional body 30 may be a Class VII flextensional structure, which is also called an inverse flextensional structure. Such a structure is disclosed in U.S. Pat. No. 3,258,738 (Merchant). Flextensional body 30 has two relatively thin diaphragms 33 about an interior head chamber 32. Each diaphragm 33 has a generally concave form in longitudinal cross-section, as seen in FIG. 2. Flextensional body 30 proximal of diaphragms 33 includes wall 36 joining the distal ends of diaphragms 33 to a cylindrical barrel 37 that mates with cylindrical aft section 40. In this embodiment, flextensional body 30, including head mass 20, diaphragms 33, wall 36, and barrel 37, is a unitary structure 35. Aft section 40 includes a hollow cylinder having a wall 41 defining therein interior cylindrical chamber 42, which is open at its distal end to be continuous with an opening in wall 36 through to interior head chamber 32. Side wall 41 of aft section 40 is relatively stiff compared to diaphragms 33. The stiffness may be achieved by use of one or more of greater thickness, use of stiffer material, and inclusion of reinforcing materials. The proximal end of aft section 40 defines tail mass 45. Tail mass 45 may be solid.

Driver 60 is in physical contact with head mass 20 and tail mass 45. Driver 60 may be in the form of a stack of piezoelectric rings, which may be of conventional material. Driver 60 may be of any other suitable material, such as magnetostrictive material that can be driven to provide a selected vibratory frequency through the excitation provided by oscillatory magnetic fields. Driver 60 may be made of a lead-zirconate-titanate ceramic, terfenol-D or other electrostrictive, magnetostrictive, piezoceramic or piezomagnetic solid state material. In an exemplary embodiment, the transducer may be operated as a projector of acoustic signals of a desired frequency, but may also be operated as an acoustic receiver or hydrophone. For simplicity of illustration, electrical connections to the elements of driver 60 are not shown. Driver 60 changes its longitudinal length at the driven frequency.

Electrical insulators 62, 64, may be provided at each end of driver 60 to provide electrical insulation between driver 60 and head mass 20, and driver 60 and tail mass 45, respectively. Insulator 62 may be or include a tuning washer, as are known in the field of sonar transducers.

Flextensional body 30, including head mass 20, and aft section 40 together define a flexural structure 70. Flexural structure 70 maintains driver 60 under stress. Flexural structure 70 is preferably watertight.

Any suitable connection may be provided between unitary structure 35 and aft section 40. By way of example, the distal end 43 of aft section 40 may have a thread defined on an exterior surface thereof, and the barrel 37 of unitary structure 35 may have a mating thread defined on an interior surface thereof. A ring seal 39 may be provided to reduce the risk of water entering chamber 42.

Rear housing 50 is preferably isolated from aft section 40 so that vibrations of aft section 40 are not transmitted to rear housing 50. Rear housing 50 contains on-board electronics and has a connector 51 for adapting to a source of electrical power. Rear housing 50 may have defined therein a chamber for a transformer 52 adapted to receive power through connector 51 and provide current to driver 60. Transformer 52 may be mounted, for example, on stand-offs 53. A vibration decoupler 54 and an exterior seal 55 may be provided at the junction of aft section 40 and rear housing 50. Aft section 40 may have a solid cylindrical member 48 at its proximal end which is received in a bore defined in rear housing 50. Seals, such as O-ring seals 56, may be provided intermediate cylindrical member 48 and rear housing 50.

Figure 3:
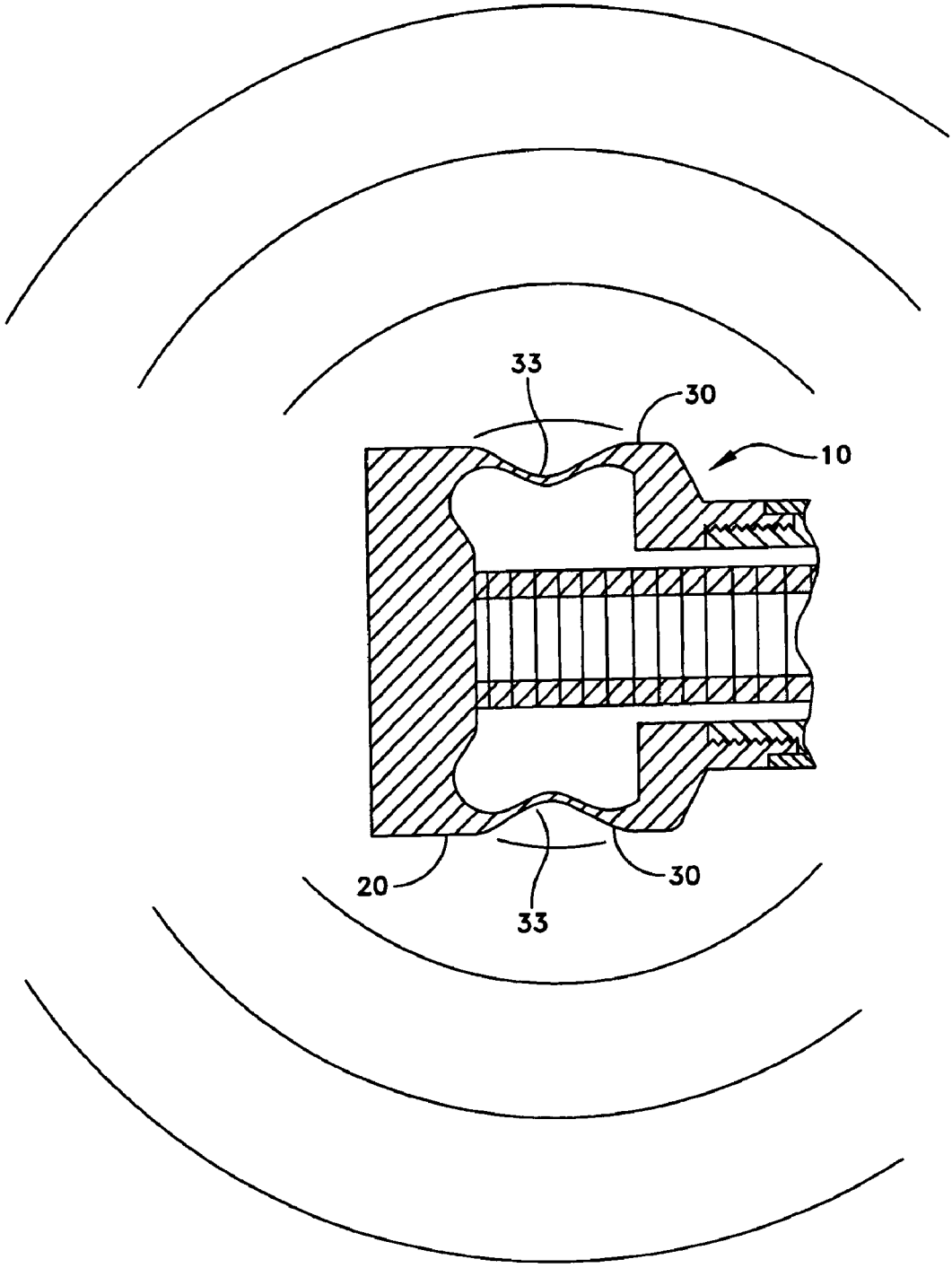
FIG. 3 is a schematic view of the transducer of FIGS. 1A and 1B operating in a low frequency mode.

In an exemplary embodiment, transducer 10 has three resonant modes. A first or fundamental resonant mode, having a relatively low resonant frequency, involves substantially only a bending motion of flextensional body 30, and particularly substantially only of diaphragms 33. The frequency range of this first mode may be below 1 kHz. In some embodiments, the wavelength in this frequency range is much longer than any dimension of transducer 10; as a result, transducer 10 serves as substantially an omnidirectional radiator. Referring to FIG. 3, transducer 10 operating in the first mode is illustrated. The lines illustrate exemplary peaks of ultrasound signals emitted by transducer 10 in the first mode. The lines near diaphragms 33 illustrate that the signal is provided substantially exclusively by bending of diaphragms 33.

Figure 4:
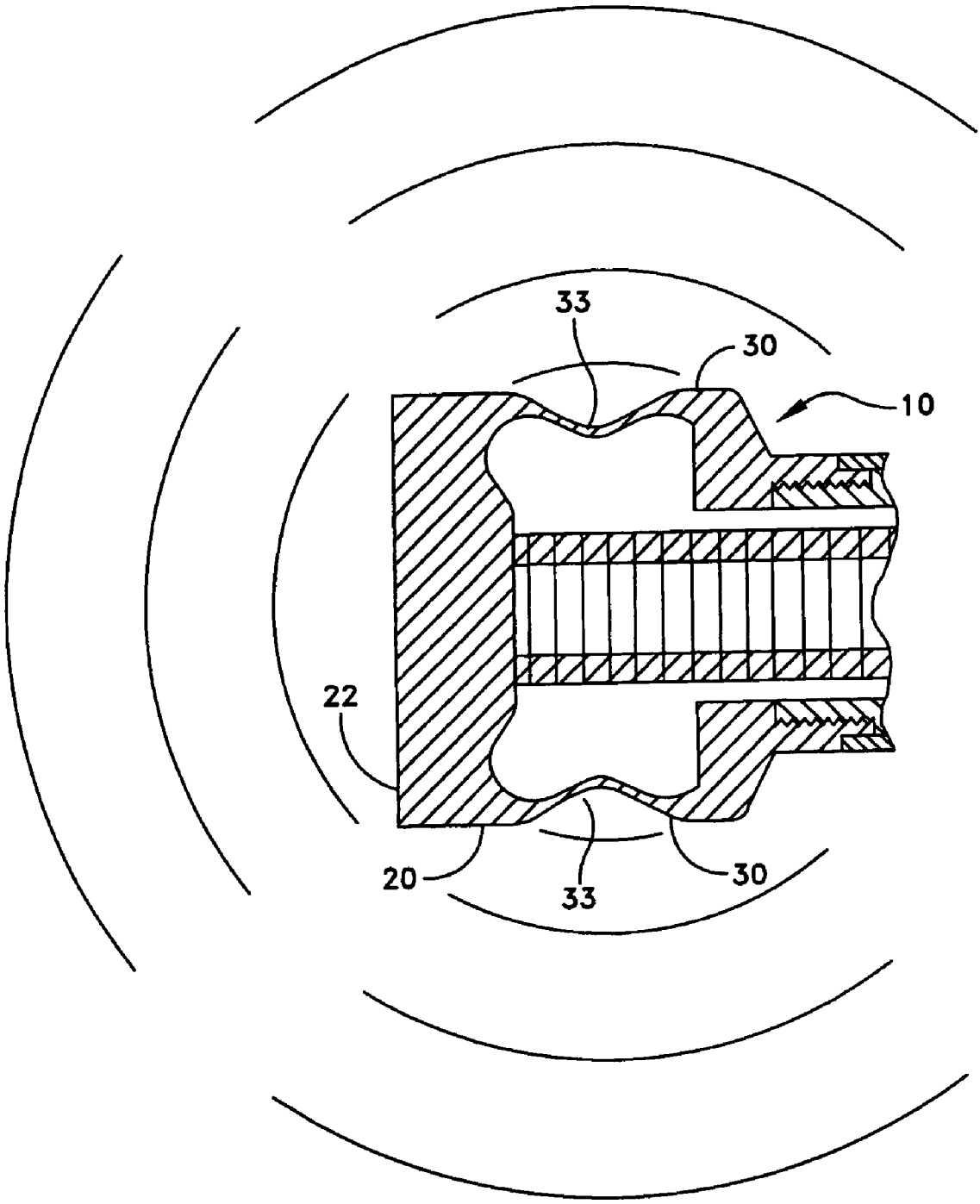
FIG. 4 is a view, similar to FIG. 3, showing the transducer operating in an intermediate frequency mode.

A second resonant mode, at a frequency higher than the frequency associated with the fundamental mode, involves both a bending motion of diaphragms 33 and a radial breathing or membrane motion of flextensional body 30, which motion includes head mass 20. This second resonant mode has a resonant frequency that may be in a range around about 1500 Hz. In FIG. 4, this second mode is illustrated somewhat schematically, showing waves emitted by both diaphragms 33 and planar face 22 of head mass 20. Adjacent peaks are shown closer together in FIG. 4 than in FIG. 3, to indicate that the mode of FIG. 4 is of a shorter wavelength than the mode of FIG. 3.

Figure 5:
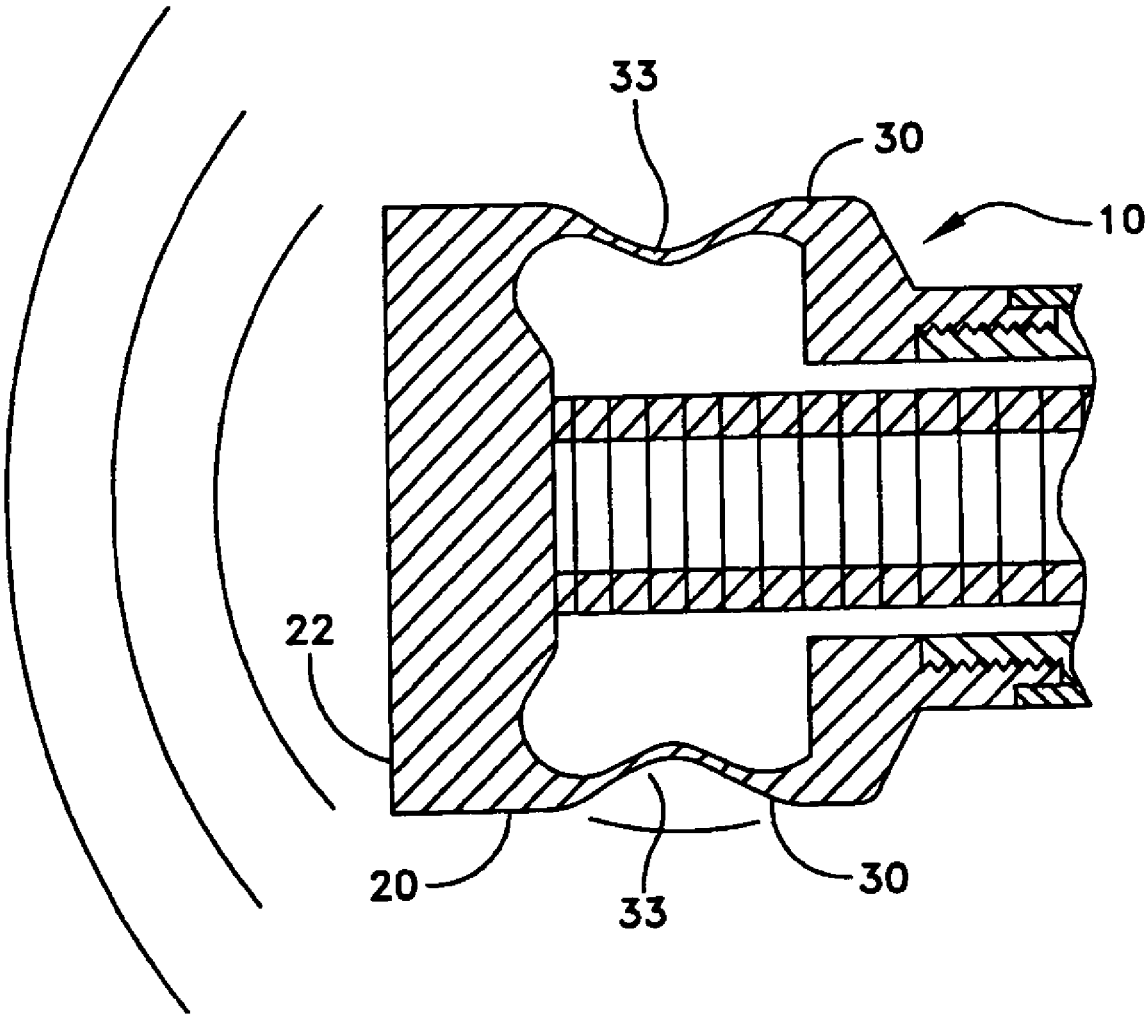
FIG. 5 is a view, similar to FIG. 3, showing the transducer operating in a relatively high frequency mode.

A third, relatively high frequency resonant mode, involves exclusively or substantially exclusively longitudinal motion of head mass 20. This third resonant mode may have a frequency range from about 2200 Hertz to about 3700 Hertz. This mode is illustrated somewhat schematically in FIG. 5. Peaks are shown emitted from face 22 of head mass 20.

Figure 6:
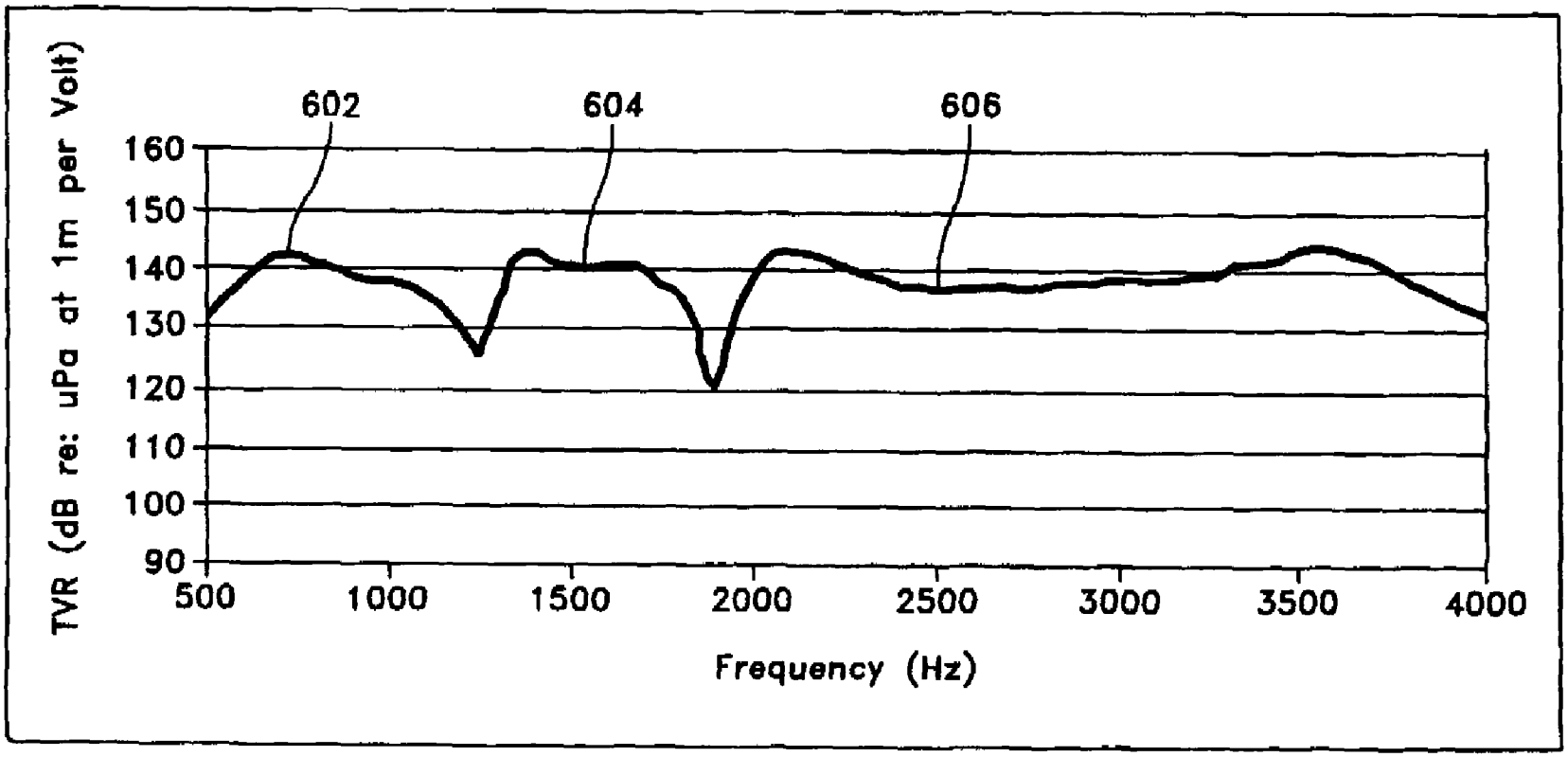
FIG. 6 is a graph showing frequency response from a simulation of a transducer according to an embodiment of the present invention.

FIG. 6 is a graph showing frequency response from a simulation of a transducer according to an embodiment of the present invention. Signal strength is shown as transmitting voltage response (TVR). TVR is pressure, at a 1-meter range, re: 1 microPascal per volt of excitation, in decibels. Frequency is shown in Hertz. The first, relatively low-frequency mode is shown at reference 602. The second, intermediate frequency mode is shown at reference 604. The third, relatively high frequency mode, is shown at reference 606. The results of this simulation show that relatively wide bandwidth is expected for each mode.

In an embodiment of the invention, the drive point impedance of structure 70 may be less than the drive point impedance of driver 60. By way of example, the drive point impedance of structure 70 may be about 0.4 times the drive point impedance of driver 60.

Head mass 20 is preferably stiffer than diaphragms 33. Aft section 40 is preferably stiffer than both head mass 20 and diaphragms 33. The materials used for unitary structure 35 and aft section 40 may reflect differential stiffness. By way of example, unitary structure 35 may be of aluminum, and aft section 40 may be of steel, titanium, e-glass or graphite. As noted above, side wall 41 of aft section 40 may be relatively thick, compared to diaphragms 33, to provide side wall 41 with greater stiffness. By way of example, the thickness of side wall 41 may be about 5 to about 10 times the thickness of diaphragms 33. The ratio of the mass of tail mass 45 to the mass of head mass 20 is relatively high, and may be about 5 to 1. Driver 60 causes significantly greater movement of head mass 20 than of tail mass 45.

Numerous modifications may be made to the illustrated embodiment. For example, substitutions of materials may be made. Those of skill in the art will appreciate that unitary components may in some cases be made of multiple parts, and that multi-component parts may be made as unitary components.

An advantage of the described structure is obtaining a relatively low frequency sonar transducer with a relatively large bandwidth. A further advantage of the described structure is the availability of three resonant frequencies.

While the foregoing invention has been described with reference to the above described embodiment, various modifications and changes can be made without departing from the spirit of the invention. Accordingly, all such modifications and changes are considered to be within the scope of the invention.

What is claimed is:

1. A sonar transducer comprising:

a head mass at a distal end thereof, a tail mass at a proximal end thereof, a driver in physical contact with the head mass and the tail mass, and an inverse flextensional body incorporating and extending proximally from the head mass, wherein said inverse flextensional body includes vertical and parallel end walls joined by a pair of concave upper and lower diaphragms.

2. The transducer of claim 1 wherein said inverse flextensional body includes one end wall defined by the head mass, a second end wall defined by a walled end region and walls on opposite sides having a concave shape and joining the head mass and the second end wall.

3. The transducer of claim 2, wherein said one end wall comprises a planar surface.

4. The transducer of claim 1, wherein an aft section includes said tail mass at a proximal end thereof, said aft section mating at a distal end with said flextensional body, and wherein said aft section includes side walls having a relative stiffness greater than the stiffness of said head mass and said diaphragms.

5. A sonar transducer comprising:

a head mass at a distal end thereof, a tail mass at a proximal end thereof, a driver in physical contact with the head mass and the tail mass, and an inverse flextensional body incorporating and extending proximally from the head mass, wherein an aft section includes said tail mass at a proximal end thereof, said aft section mating at a distal end with said flextensional body, and wherein said aft section includes side walls having a relative stiffness greater than the stiffness of said head mass and said diaphragms, and wherein said transducer is operative in one of a first relatively low frequency resonant mode defined by only a bending motion of said flextensional body in response to a driving signal; a second relatively higher frequency resonant mode higher than the frequency associated with the first mode, defined by a bending motion of the diaphragms and a radial motion of the flextensional body in response to a second driving signal; and a third high frequency resonant mode higher than that of said first and second modes, defined by a substantially exclusively longitudinal motion of the flextensional body, in response to a third driving signal.

6. The transducer of claim 5, wherein said first mode is below about 1 KHz, said second mode is about 1.5 KHz, and said third mode is about 2.2 KHz to 3.7 KHz.

7. A sonar transducer comprising:

an inverse flextensional body having a longitudinal axis and including a head mass, said flextensional body extending proximally of the head mass;

an aft section in alignment along said longitudinal axis and matingly coupled with said inverse flextensional body at a distal end, and including a tail mass at a proximal end thereof, said aft section having a diameter smaller than the dimensions of a front planer surface of said head mass;

a driver in physical contact with the head mass and the tail mass; wherein the inverse flextensional body has a pair of substantially concave cross-sectional shaped opposing side diaphragms in a direction orthogonal to the longitudinal axis; and wherein a rear housing is attached to said tail mass.

8. The transducer of claim 7, wherein said inverse flextensional body further comprises side plates to seal the interior open sides of the flextensional body.

9. The transducer of claim 7, wherein said diaphragms are disposed about an interior head chamber.

10. The transducer of claim 7, wherein a wall proximal of the diaphragms joins the distal ends of the diaphragms to a cylindrical barrel section that mates with the aft section.

11. The transducer of claim 7, wherein the ratio of the tail mass to the head mass is approximately 5 to 1.

12. A sonar transducer comprising: a flextensional body having a head mass, a tail mass, opposing diaphragms, a wall, and a barrel section forming a unitary structure; an aft section having a hollow cylinder defining therein an interior chamber which is open at its distal end and continuous with an opening in a wall to an interior head chamber of said flextensional body, said opposing diaphragms located about said interior head chamber, and a driver in physical contact with the head mass and the tail mass and housed within said aft section, wherein said driver changes its longitudinal length in accordance with a driven frequency.

13. The transducer of claim 12, wherein the driver is one of a stack of piezoelectric rings or magnetostrictive material.

14. The transducer of claim 12, wherein the driver produces oscillatory magnetic fields at one or more selected vibratory frequencies.

15. The transducer of claim 12, wherein the driver is made of one of a lead-zirconate-titanate ceramic, terfenol-D or other electrostrictive, magnetostrictive, piezoceramic or piezomagnetic solid state material.

16. The transducer of claim 12, further comprising insulators provided at each end of the driver to provide electrical insulation between the driver and the head mass, and the driver and the tail mass.

17. The transducer of claim 16, wherein the insulators include a tuning washer.

18. The transducer of claim 12, wherein a drive point impedance of the transducer structure is less than the drive point impedance of the driver.

19. The transducer of claim 12, wherein the unitary structure and aft section materials reflect differential stiffness.

20. The transducer of claim 12, wherein said flextensional body includes vertical and parallel end walls joined by said opposing diaphragms, said opposing diaphragms being substantially concave.

* * * * *